US005468933A

United States Patent [19]

Eller

[11] Patent Number: 5,468,933

[45] Date of Patent: Nov. 21, 1995

[54] ROD FLAME GLOW PLUG HAVING A COFE ALLOY REGULATING COIL AND A HOUSING HAVING A FUEL CONNECTION FOR A METERING DEVICE

[75] Inventor: Martin Eller, Ludwigsburg, Germany

[73] Assignee: Beru Ruprecht GmbH & Co. KG, Ludwigshafen, Germany

[21] Appl. No.: 183,341

[22] Filed: Jan. 19, 1994

[30] Foreign Application Priority Data

Jan. 19, 1993 [DE] Germany ..... 43 01 252.3

[51] Int. Cl.[6] ..... F23Q 7/00; F02N 17/047; H05B 3/48

[52] U.S. Cl. ..... 219/270; 123/145 A; 361/266

[58] Field of Search ..... 219/270; 338/238; 123/145 R, 145 A; 361/264–266

[56] References Cited

U.S. PATENT DOCUMENTS

| | | | |
|---|---|---|---|
| 4,459,948 | 7/1984 | Bauer | 219/270 X |
| 4,639,712 | 1/1987 | Kobayashi et al. | 338/238 |
| 4,963,717 | 10/1990 | Woefle | 219/270 X |
| 5,091,631 | 2/1992 | Dupuis et al. | 219/270 |
| 5,093,555 | 3/1992 | Dupuis et al. | 219/270 |
| 5,118,921 | 6/1992 | Aota | 219/270 |
| 5,130,517 | 7/1992 | Schmid et al. | 219/270 |
| 5,132,516 | 7/1992 | Hatanaka et al. | 219/270 |
| 5,172,664 | 12/1992 | Mueller et al. | 219/270 X |
| 5,206,483 | 4/1993 | Aota | 219/270 |
| 5,319,180 | 6/1994 | Locher et al. | 219/270 |

FOREIGN PATENT DOCUMENTS

| | | | |
|---|---|---|---|
| 336625 | 10/1989 | European Pat. Off. . | |
| 3035291 | 4/1982 | Germany . | |
| 8809396 | 12/1989 | Germany . | |
| 4007340 | 10/1990 | Germany . | |
| 4029185 | 3/1992 | Germany . | |
| 62-37622 | 2/1987 | Japan | 219/270 |
| 2136504 | 9/1984 | United Kingdom . | |
| 2216952 | 10/1989 | United Kingdom | 219/270 |
| WO91-15717 | 10/1991 | WIPO | 219/270 |

*Primary Examiner*—John A. Jeffery
*Attorney, Agent, or Firm*—Sixbey, Friedman, Leedom & Ferguson; David S. Safran

[57] ABSTRACT

Rod flame glow plug for preheating the intake air of an autoignition internal combustion engine with a housing having a fuel connection with a metering device and an electric connection, and at least one heating rod located in the housing. The heating rod is formed of a glow tube (8) filled with an electrically insulative filling material (10) and at least one regulating coil (2) and a heating coil (1). The coils are embedded in the filling material (10) and are connected in series to one another and with the electric connection (9). The regulating coil (2) is formed of a CoFe alloy.

13 Claims, 4 Drawing Sheets

ROD FLAME GLOW PLUG HAVING A COFE ALLOY REGULATING COIL AND A HOUSING HAVING A FUEL CONNECTION FOR A METERING DEVICE

BACKGROUND OF THE INVENTION

1. Field of the Invention

The invention relates to a rod flame glow plug for preheating the intake air of an internal combustion engine with autoignition having a housing, which has a fuel connection with metering device and an electric connection, and at least one heating rod, which is placed in the housing and is formed from a glow tube in which at least one regulating coil and at least one heating coil are embedded in a filling material and are connected in series to one another and the electric connection.

2. Description of Related Art

Such a rod flame glow plug, which is known, for example, from German Patent 40 07 340, is used to heat the intake air of an internal combustion engine with autoignition, for example, of a diesel engine, if starting problems in the autoignition occur because of low temperatures.

Rod flame glow plugs are known in configurations with one or more heating rods as well as with single or multiple coil combinations of regulating and heating coils. If a voltage is applied to such a rod flame glow plug, a current flows through the coil combination of regulating and heating coils, so that the heating coil, whose resistance value is almost independent of the temperature, glows first. By heating the regulating coil material, which has a positive resistance temperature coefficient and therefore, with increasing temperature, reduces the current by its inherent resistance, the heating coil is protected from overheating.

The regulating coils usually consist of pure nickel, i.e., Ni 99.9. But this material has a regulating behavior, i.e., a resistance behavior relative to the down-regulation of the current by the temperature, which results in relatively long heating-up times. The flat rise of the temperature curve, which is responsible for the long heating-up time to reach ignition temperature, without timing function when the generator voltage is applied, does not correspond to the requirements for a quick starting of the internal combustion engine, especially within about 15 seconds.

SUMMARY OF THE INVENTION

The primary object of the present invention is, therefore, to provide a rod flame glow plug, of the initially-mentioned type, which has a shorter heating-up time to reach the ignition temperature and does not have to be synchronized to intercept the high voltages.

This object is achieved according to the invention in that the regulating coil is formed of a CoFe alloy, preferably, Co8Fe or Co25Fe.

The resistance behavior relative to the down-regulation of the current towards the temperature is significantly higher with CoFe alloys than with nickel, and the resulting regulating factor is coupled proportionally with the temperature of the heating rod.

Other advantages are obtainable in accordance with the present invention by providing the regulating coil with a winding distance that is greater in an end area near the at least one heating coil than in other areas thereof, and by the one heating coil with a winding distance that is greater in an area of the glow rod tip than in other areas. The larger winding distance of the regulating coil produces a later down-regulation of the regulating coil by heat removal, while the larger winding distance results in a better heat distribution and a better filling with insulative filling material.

Additionally, preferably the insulative filling material is one having high heat conduction characteristics, such as AlN, at least in proximity to the heating coil, and is formed of a material having poorer heat conduction characteristics, such as MgO, in proximity to the regulating coil. In this way, heat is quickly removed from the heating coil but heating of the regulating coil is delayed.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 4:
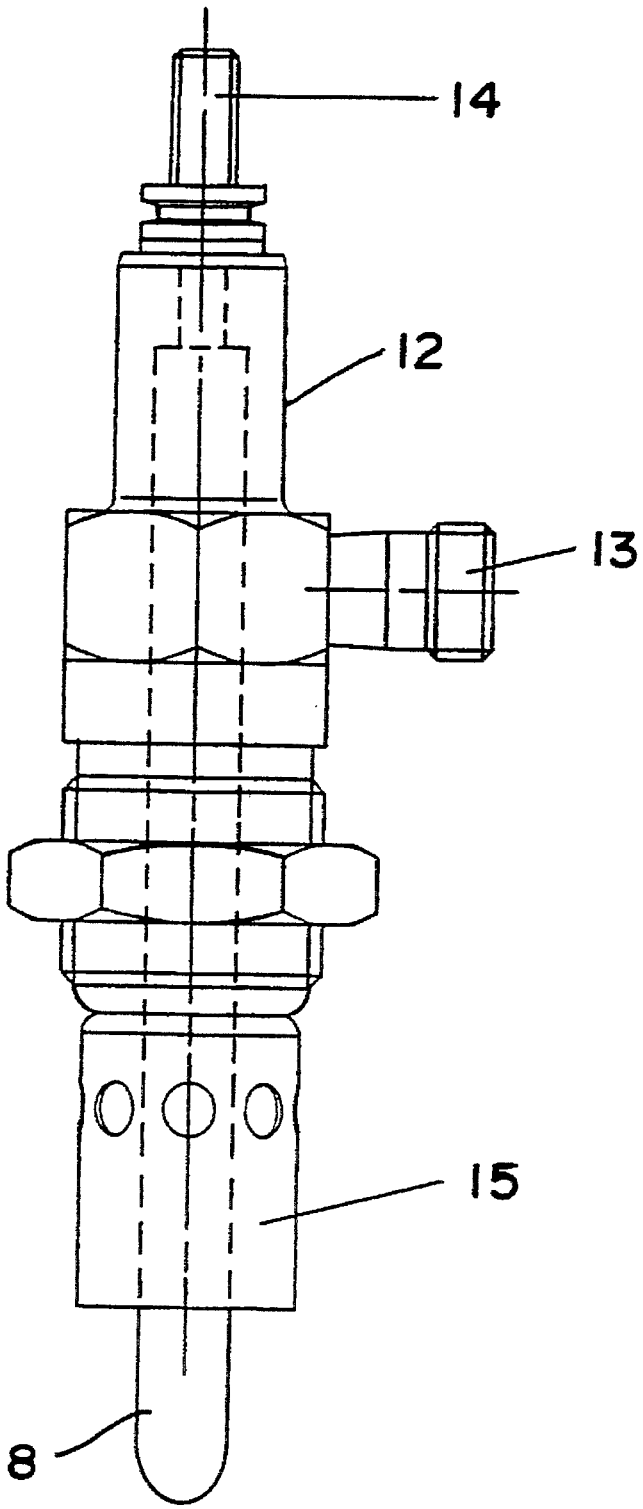
FIG. 4 is an elevational view showing the basic design of a rod flame glow plug.

As it is represented in FIG. 4, a rod flame glow plug usually is formed of a housing 12 with a fuel connection 13 for a fuel metering device and an electric connection 14 for a power supply. Inside of the housing 12, there is a heating rod, which projects from the downstream end of housing 12 and is surrounded there by a protective tube 15, which is connected axially to the downstream end of housing 12. Inside the housing, fuel fed to fuel connection 13 is heated by the heating rod, which is supplied with current by electrical connection 14, is evaporated and finally ignited. Such a rod flame glow plug is placed in the intake air current of an internal combustion engine, so that the flame resulting in this connection heats the intake air. As a result, starting of an internal combustion engine is also possible at temperatures which are so low that, with autoignition (diesel) engines, starting problems would occur.

Figure 1:
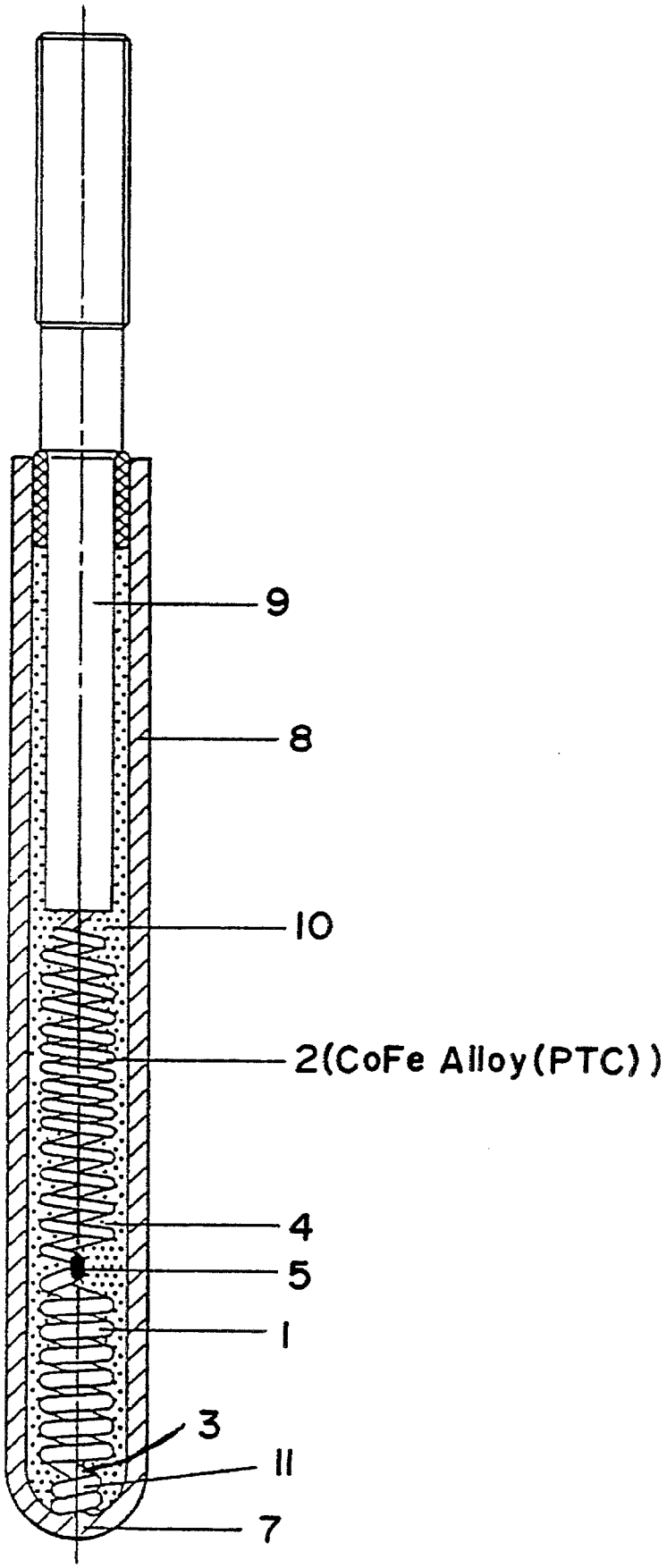
FIG. 1 is a sectional view of the heating rod in a first embodiment of the rod flame glow plug according to the invention.

As it is represented in FIG. 1, a first embodiment of the inventive heating rod is comprised of a glow tube 8, which is filled with an electrically insulative filling material 10, and within which at least one regulating coil 2 and one heating coil 1 are embedded. Coils 1, 2 are connected in series to one another, by being welded with one another at a weld point 5, and the electric connection, i.e., with an internal pole 9 as well as with glow tube 8 (by a welding nugget 7) serving as ground in the embodiment represented in FIG. 1.

If a voltage is between internal pole 9 and glow tube 8, then a current flows through the coil assembly of heating and glow coils 1 and 2. Since the heating coil 1 is formed of a material whose resistance value is almost constant with changes in temperature, heating coil 1 glows first. By the then starting of heating of the regulating coil 2 material, which has a positive temperature coefficient and thus, reduces the current by its inherent resistance with increasing temperature, heating coil 1 is protected from overheating. The regulating coil 2 material is a CoFe alloy, preferably Co8Fe or Co25Fe, i.e., alloys containing 8 or 25% iron and the remainder cobalt.

As it is further represented in FIG. 1, the winding distance in 4 front area of regulating coil 2, i.e., on the end connected to the heating coil, is greater than in the remaining area of regulating coil 2, which produces a later down-regulation of regulating coil 2 by heat removal. Since the regulating coil wire changes the resistance by the temperature, the heat dissipation or heat conduction of heating coil 1 influences the regulating behavior of regulating coil 2. For this regulating behavior, both the distance between the individual regulating coil windings (winding distance) as well as the distance between heating and regulating coils 1, 2 are therefore decisive. The gap. i.e., the distance between the windings on the ends of regulating coil 2 and heating coil 1 connected with one another thus likewise contribute to the delay of the down-regulation.

Figure 2:
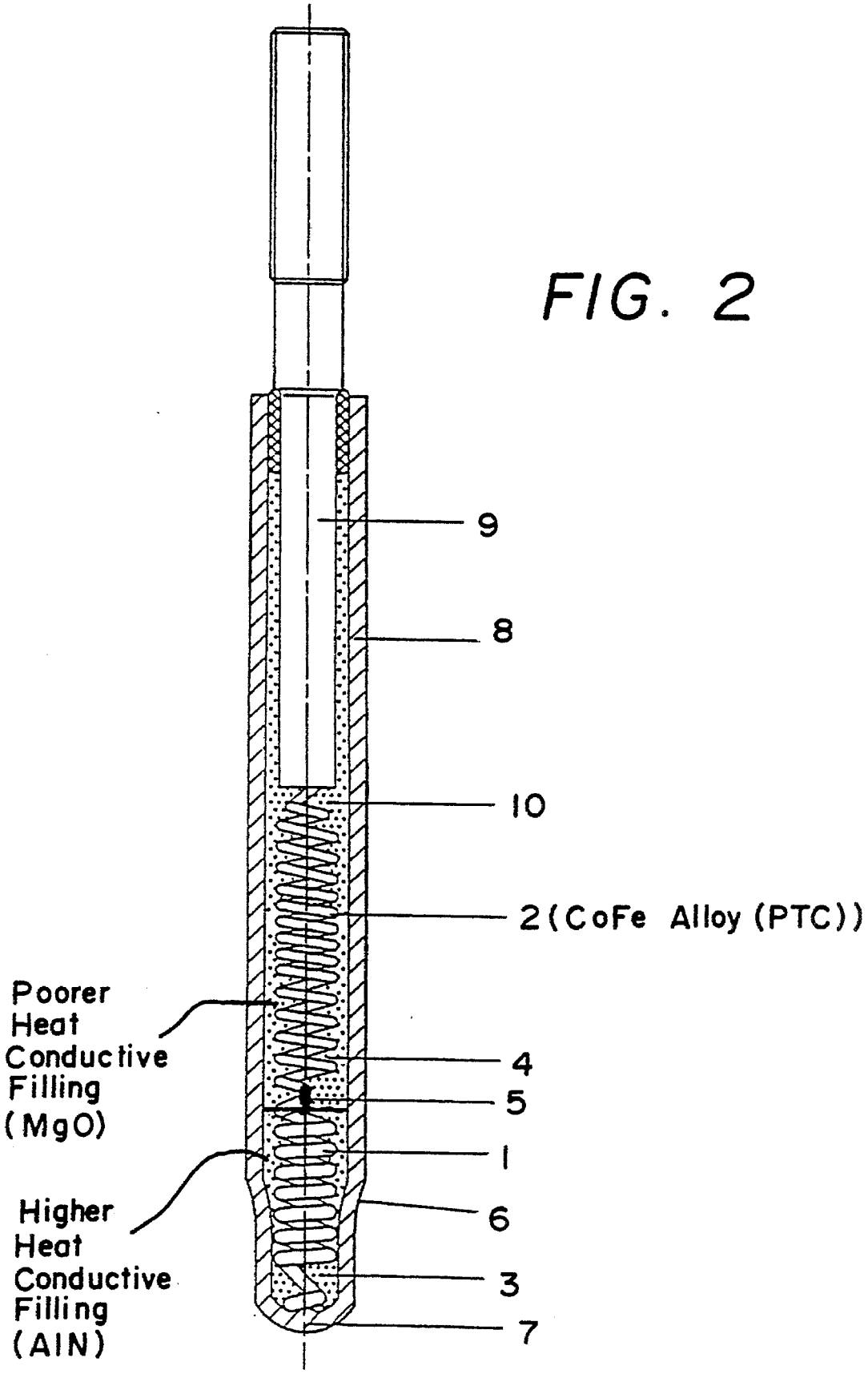
FIG. 2 is a sectional view of the heating rod in a second embodiment of the rod flame glow plug according to the invention.

As it is further represented in FIG. 1, the front area of heating coil 1, i.e., the downstream end at which heating coil 1 is welded with glow tube 8, also has a greater winding distance 3 than on the remaining area of heating coil 1. As a result, a better heat distribution and a better filling with insulative filling material 10 is achieved. Furthermore, this construction of the heating coil 1 makes it possible to achieve a higher compression of filling material 10 by the provision of a glow rod tip portion 6 of the glow tube 8 of reduced diameter, according to the embodiment of FIG. 2. This reduction of the tip portion 6 of glow tube 8 results in a compression of filling material 10 in the area of the first to third winding of heating coil 1 and thus in a compaction thereof. By the winding distance or gap 3 in heating coil 1, coil 1 is prevented from resting on glow tube 8, due to reduction 6, and an undefined merging of double turn 11, represented in FIG. 1, is further prevented on the heating coil end.

The additional reduction with a compaction of the heating wire of heating coil 1 further produces a significantly higher service life, since the wire is not so quickly burned through because of the wire compaction.

Filling material 10, with which glow tube 8 is filled and in which regulating and heating coils 1, 2 are embedded, is formed, at least partially, i.e., at least in the area of heating coil 1, of AlN, i.e., a material with high heat conduction to provide for a quick removal of heat from heating coil 1 to the surface of glow tube 8. In regulating coil area 2, the filling material preferably consists of MgO, i.e., a material with poorer heat conduction than AlN, which has the result that, on the one hand, the heat of heating coil 1 is quickly removed outside, while, on the other hand, the heating of regulating coil 2 by the heat of heating coil 1 is delayed.

It is also possible to fill both the heating coil area and the regulating coil area with AlN and to provide a filling material of MgO in the space between heating and regulating coils 1, 2.

Finally, the complete filling can also consist of AlN, if winding distance 4 and the winding gap between heating and regulating coils 1, 2 are suitably set to compensate for the resulting greater heat conductivity of the filling material.

Figure 3:
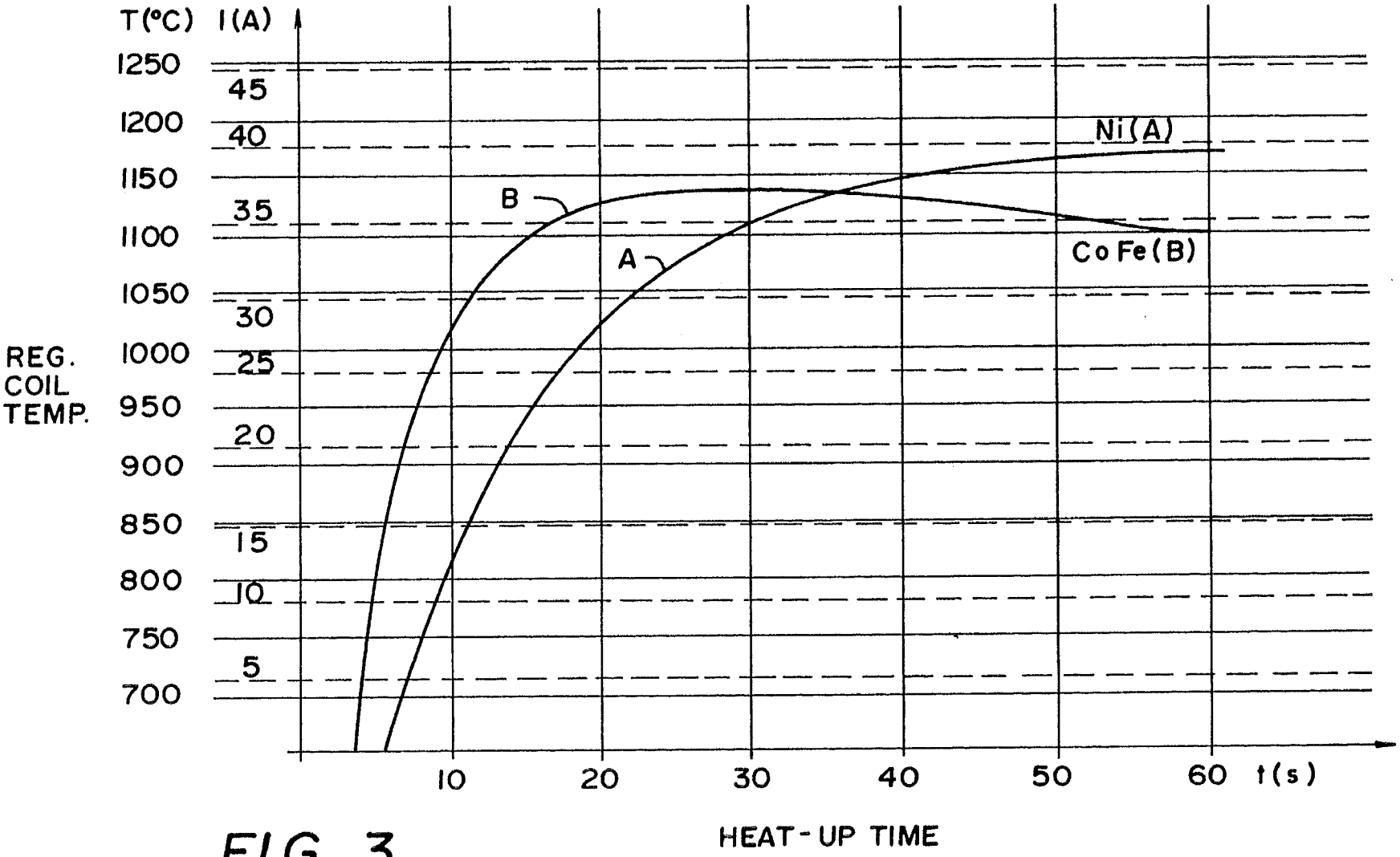
FIG. 3 is a temperature-time chart showing the heating-up time for an embodiment of the rod flame glow plug according to the invention with regulating coil made of CoFe and of a conventional rod flame glow plug with regulating coil made of Ni.

In the rod flame glow plug according to the invention, in which the regulating coil consists of a CoFe alloy, a quicker heating-up time with simultaneous assurance against burning through is thus achieved by the strong down-regulation. This effect is thus reinforced or supported in that the winding distances and the filling materials are selected in the above-indicated way. The resistance behavior relative to the down-regulation of the current relative to the temperature is significantly higher with CoFe alloys than with nickel, and the resulting regulating factor is coupled proportionally with the temperature of the heating rod. The heating-up times of a rod flame glow plug with a regulating coil made of a CoFe ahoy according to the invention and a regulating coil made of Ni are represented in the comparison in FIG. 3 of the related drawing, where curve A represents the inventive use of a CoFe alloy and curve B represents the conventional use of a regulating coil made of Ni.

The reduction produces a compression of the filling material with simultaneous compaction of the heating wire, and the compression, on the one hand, produces a better heat removal, and on the other hand, a pressing out of the oxygen, which otherwise could lead to the destruction of the coil elements.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Rod flame glow plug for preheating intake air of an autoignition internal combustion engine comprising:

a housing having a fuel connection for a metering device and an electric connection for a power supply at a first end portion thereof and having an axially extending inner space at an opposite end portion thereof, and at least one heating rod, said heating rod being located in the axially extending inner space of the housing so as to project from said housing at a free end of the heating rod, said heating rod being formed of a glow tube filled with an electrically insulative filling material and a coil assembly having at least one regulating coil and at least one heating coil, the glow tube having a closed end and the coils of said coil assembly being embedded in the filling material and being connected in series to one another and to the electric connection with the at least one heating coil located nearer to the closed tip end of the glow tube than the at least one regulating coil;

wherein the regulating coil is formed of a CoFe alloy; and wherein a distance between each of plural adjacent windings of the at least one regulating coil in an area of the end thereof which is connected to the at least one heating coil is greater than a distance between windings of the at least one regulating coil in other areas thereof.

2. Rod flame glow plug according to claim 1, wherein the CoFe alloy is Co8Fe.

3. Rod flame glow plug according to claim 1, wherein the CoFe alloy is Co25Fe.

4. Rod flame glow plug according to claim 1, wherein a distance between windings of the at least one heating coil is greater in an area of the closed end of the glow rod than in other areas.

5. Rod flame glow plug according to claim 4, wherein the CoFe alloy is Co8Fe.

6. Rod flame glow plug according to claim 4, wherein the CoFe alloy is Co25Fe.

7. Rod flame glow plug according to claim 4, wherein the filling material is AlN, at least in proximity to the at least one heating coil.

8. Rod flame glow plug according to claim 1, wherein the filling material is AlN, at least in proximity to the at least one heating coil.

9. Rod flame glow plug according to claim 8, wherein the filling material is MgO in proximity to the at least one regulating coil.

10. Rod flame glow plug according to claim 8, wherein the filling material is AlN in proximity to both the heating coil and the at least one regulating coil area, and wherein the filling material is made of MgO between the at least one heating coil and the at least one regulating coil.

11. Rod flame glow plug according to claim 8, wherein the CoFe alloy is Co8Fe.

12. Rod flame glow plug according to claim 8, wherein the CoFe alloy is Co25Fe.

13. Rod flame glow plug according to claim 1, wherein the glow tube has a tip portion of a diameter that is reduced relative to a remaining portion thereof.

* * * * *